US009202409B2

(12) United States Patent
Han

(10) Patent No.: US 9,202,409 B2
(45) Date of Patent: Dec. 1, 2015

(54) PIXEL, DISPLAY DEVICE INCLUDING THE SAME, AND DRIVING METHOD THEREOF

(71) Applicant: Samsung Display Co., Ltd., Yongin, Gyeonggi-do (KR)

(72) Inventor: Sang-Myeon Han, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 283 days.

(21) Appl. No.: 13/752,245

(22) Filed: Jan. 28, 2013

(65) Prior Publication Data

US 2014/0071108 A1 Mar. 13, 2014

(30) Foreign Application Priority Data

Sep. 10, 2012 (KR) ..... 10-2012-0100102

(51) Int. Cl.
*G09G 5/00* (2006.01)
*G09G 3/30* (2006.01)
*G09G 3/32* (2006.01)

(52) U.S. Cl.
CPC ..... *G09G 3/3208* (2013.01); *G09G 3/3233* (2013.01); *G09G 2300/0819* (2013.01); *G09G 2300/0852* (2013.01); *G09G 2300/0866* (2013.01); *G09G 2310/0262* (2013.01); *G09G 2320/0209* (2013.01); *G09G 2320/0223* (2013.01); *G09G 2320/043* (2013.01)

(58) Field of Classification Search
CPC ..... G09G 3/3233; G09G 3/3291; G09G 2320/045; G09G 2300/043; G09G 2300/0866; G09G 2310/0262; G09G 3/3266; G09G 3/3696; G09G 3/3208; G09G 3/3225; G09G 2300/0439; G09G 2310/0264; G09G 2320/029
USPC ..... 345/73–84, 204–215, 690–699; 315/169.1–169.4
See application file for complete search history.

(56) References Cited

U.S. PATENT DOCUMENTS

2009/0309818 A1* 12/2009 Kim ..... 345/77
2011/0025671 A1* 2/2011 Lee ..... 345/211
2011/0109531 A1* 5/2011 Choi ..... 345/76

FOREIGN PATENT DOCUMENTS

KR 10-2009-0048823 A 5/2009
KR 10-2011-0013692 A 2/2011
KR 10-2011-0013693 A 2/2011

* cited by examiner

*Primary Examiner* — Kent Chang
*Assistant Examiner* — Scott Au
(74) *Attorney, Agent, or Firm* — Knobbe, Martens, Olson & Bear, LLP

(57) ABSTRACT

An organic light emitting diode (OLED) display device is disclosed. In one aspect, the display device includes a plurality of pixels. The plurality of pixels respectively include: 1) a first capacitor connected between a data line and a first node and 2) a switching transistor including a gate electrode connected to a scan line and first and second electrodes respectively connected to the first node and a second node. The display device also includes a driving transistor including a first electrode connected to a first power source voltage and a second electrode connected to an anode of an organic light emitting diode (OLED). The device further includes a compensation transistor including a first electrode connected to the first node and a second electrode connected to the second electrode of the driving transistor.

16 Claims, 5 Drawing Sheets

PIXEL, DISPLAY DEVICE INCLUDING THE SAME, AND DRIVING METHOD THEREOF

CROSS-REFERENCE TO RELATED APPLICATION

This application claims priority to and the benefit of Korean Patent Application No. 10-2012-0100102 filed in the Korean Intellectual Property Office on Sep. 10, 2012, the entire contents of which are incorporated herein by reference.

BACKGROUND (a) Field

The described technology generally relates a pixel, a display device including the same, and a driving method thereof.

(b) Description of the Related Technology

An organic light emitting diode (OLED) display uses an OLED for controlling luminance by current or voltage. The OLED includes an anode layer and a cathode layer for forming an electric field, and an organic light emitting material electric field for emitting light by the electric field.

Generally, an OLED display is classified into either a passive matrix OLED (PMOLED) or an active matrix OLED (AMOLED) according to how the diodes are driven.

In view of resolution, contrast, and operation speed, the AMOLED that is selectively turned on for every unit pixel is preferred for most commercial applications.

SUMMARY

One inventive aspect is a pixel that is robust to a coupling or a leakage current caused by an external voltage, a display device including the same, and a driving method thereof.

Another aspect is a display device which includes a plurality of pixels, wherein the plurality of pixels respectively include: a first capacitor including one electrode connected to a data line and the other electrode connected to a first node; a switching transistor including a gate electrode connected to a scan line, one electrode connected to the first node, and the other electrode connected to a second node; a driving transistor including a gate electrode connected to a second node, one electrode connected to a first power source voltage, and the other electrode connected to an anode of an organic light emitting diode (OLED); a compensation transistor including a gate electrode connected to a compensation control line, one electrode connected to the first node, and the other electrode connected to the other electrode of the driving transistor; and a second capacitor including one electrode connected to the second node and the other electrode connected to the first power source voltage.

A scan driver applying a scan signal of a gate-on voltage to a plurality of scan lines connected to a plurality of pixels during a first period included in a reset period for resetting a driving voltage of the organic light emitting diode (OLED) may be further included.

A power supply unit applying a first power source voltage as a logic low level voltage during a second period included in the reset period and applying the second power source voltage applied to the cathode of the organic light emitting diode (OLED) as a logic high level voltage may be further included.

A compensation control signal unit applying a compensation control signal of the gate-on voltage to a plurality of compensation control lines connected to a plurality of pixels during a threshold voltage compensation period for compensating a threshold voltage of the driving transistor after the reset period may be further included.

The scan driver may apply the scan signal of the gate-on voltage during the threshold voltage compensation period to a plurality of scan lines connected to a plurality of pixels to connect the first node and the second node.

A data driver applying a sustain voltage to a plurality of data lines connected to a plurality of pixels during the reset period and the threshold voltage compensation period and applying a data voltage to a plurality of data line during a scan period in which a plurality of scan signals are sequentially applied after the threshold voltage compensation period may be further included.

Another aspect is a display device which includes a plurality of pixels, and the plurality of pixels respectively include: a first capacitor including one electrode connected to a data line and the other electrode connected to a first node; a switching transistor including a gate electrode connected to a scan line, one electrode connected to the first node, and the other electrode connected to a second node; a driving transistor including a gate electrode connected to the second node, one electrode connected to a first power source voltage, and the other electrode connected to an anode of an organic light emitting diode (OLED); a compensation transistor including a gate electrode connected to a compensation control line, one electrode connected to the second node, and the other electrode connected to the other electrode of the driving transistor; and a second capacitor including one electrode connected to the second node and the other electrode connected to the first power source voltage.

A scan driver applying a scan signal of a gate-on voltage to a plurality of scan lines connected to a plurality of pixels during a first period included in a reset period for resetting a driving voltage of the organic light emitting diode (OLED) may be further included.

A power supply unit applying a first power source voltage as a logic low level voltage during a second period included in the reset period and applying a second power source voltage applied to the cathode of the organic light emitting diode (OLED) as a logic high level voltage may be further included.

A compensation control signal unit applying a compensation control signal of the gate-on voltage to a plurality of compensation control lines connected to a plurality of pixels during a threshold voltage compensation period for compensating a threshold voltage of the driving transistor after the reset period may be further included.

The scan driver may apply the scan signal of the gate-on voltage during the threshold voltage compensation period to a plurality of scan lines connected to a plurality of pixels to connect the first node and the second node.

A data driver applying a sustain voltage to a plurality of data lines connected to a plurality of pixels during the reset period and the threshold voltage compensation period, and applying a data voltage to a plurality of data line during a scan period in which a plurality of scan signals are sequentially applied after the threshold voltage compensation period, may be further included.

Another aspect is a method of driving a display device including a plurality of pixels including a first capacitor connected between a data line and a first node, a switching transistor connecting the first node and a second node according to a scan signal, and a driving transistor including a gate electrode connected to the second node and controlling a driving current supplied to an organic light emitting diode (OLED) from a first power source voltage, the method including: applying a scan signal of a gate on voltage during a first period included in a reset period to connect the first node and the second node, and applying a sustain voltage to the data line to change a voltage of the first node into a gate-on voltage by coupling due to the first capacitor; and applying the second power source voltage connected to a cathode of the organic light emitting diode (OLED) during a second period included in the reset period as a logic high level voltage, and converting the first power source voltage into a logic low level voltage to reset the anode voltage of the organic light emitting diode (OLED) into the logic low level voltage.

The method may further include turning on the switching transistor and a compensation transistor connecting the first node and the anode of the organic light emitting diode (OLED) to diode-connect the driving transistor thereby compensating a threshold voltage of the driving transistor.

The method may further include turning on the compensation transistor connecting the second node and the anode of the organic light emitting diode (OLED) to diode-connect the driving transistor thereby compensating the threshold voltage of the driving transistor.

The method may further include sequentially applying a scan signal of the gate-on voltage to turn on the switching transistor and applying a data voltage to the data line by corresponding the scan signal of the gate-on voltage to store the gate voltage of the driving transistor to the second capacitor connected between the second node and the first power source voltage.

The method may further include maintaining the first power source voltage as the logic high level and converting the second power source voltage into the logic low level for light emitting the organic light emitting diode (OLED).

Another aspect is a pixel which includes: a first capacitor including one electrode connected to a data line and the other electrode connected to a first node; a switching transistor including a gate electrode applied with the scan signal, one electrode connected to the first node, and the other electrode connected to a second node; a driving transistor including a gate electrode connected to the second node, one electrode connected to a first power source voltage, and the other electrode connected to an anode of the organic light emitting diode (OLED); and a second capacitor including one electrode connected to the second node and the other electrode connected to the first power source voltage.

A compensation transistor including a gate electrode applied with a compensation control signal, one electrode connected to the first node, and the other electrode connected to the other electrode of the driving transistor may be further included.

A compensation transistor including a gate electrode applied with a compensation control signal, one electrode connected to the second node, and the other electrode connected to the other electrode of the driving transistor may be further included.

DETAILED DESCRIPTION

Figure 1:
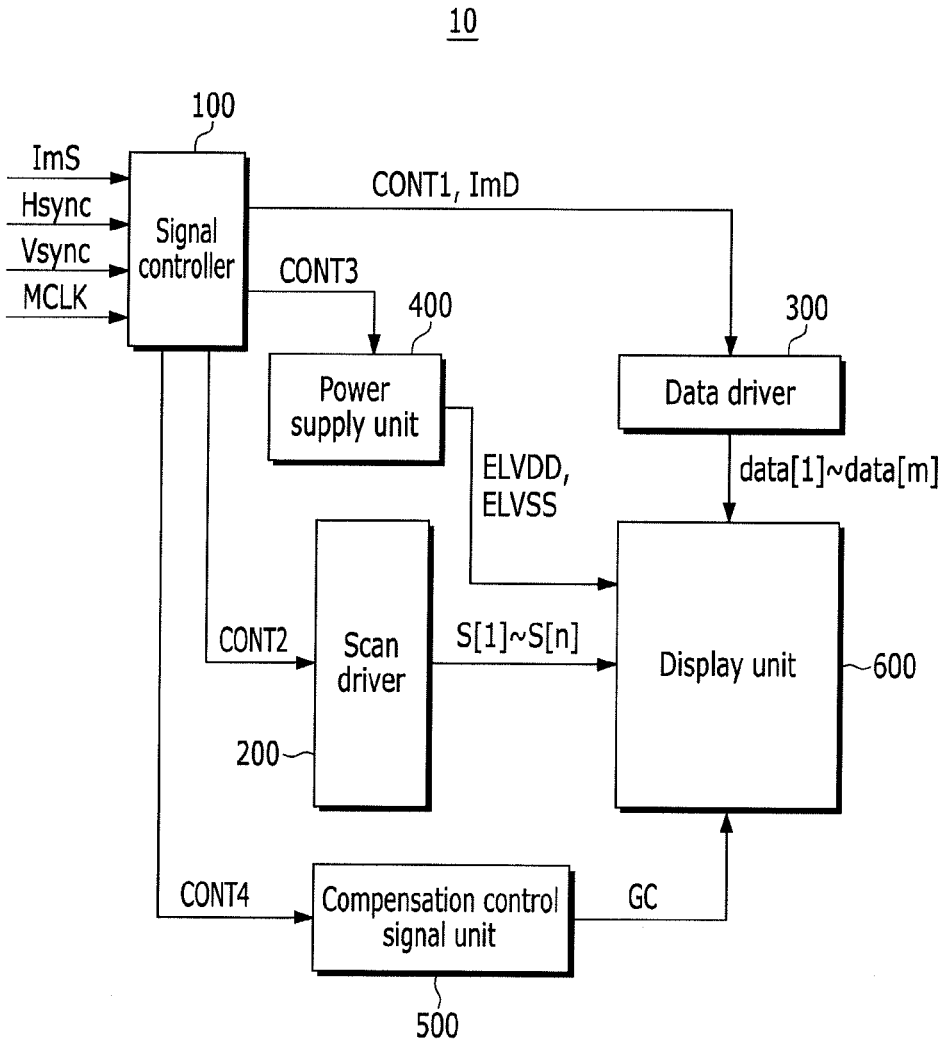
FIG. 1 is a block diagram of a display device accord to an embodiment.

One pixel of an active matrix OLED includes the organic light emitting diode, a driving transistor that controls a current amount that is supplied to the organic light emitting diode, and a switching transistor that transmits the data voltage that controls the light emitting amount of the organic light emitting diode to the driving transistor. The switching transistor is turned on by a scan signal of a gate on voltage.

If the gate voltage of the driving transistor is influenced by the coupling or the leakage current caused by an external voltage, a current amount supplied to the OLED is changed, and as a result, a light emitting amount of the diode is changed such that the display quality of the display device is reduced.

Embodiments will be described more fully hereinafter with reference to the accompanying drawings. As those skilled in the art would realize, the described embodiments may be modified in various different ways, all without departing from the spirit or scope of the present invention.

Further, in certain embodiments, constituent elements having the same construction are assigned the same reference numerals and are representatively described in connection with a first embodiment. In the remaining embodiments, only different constituent elements from those of the first embodiment are described. The same reference numbers will be used throughout the drawings to refer to the same or like parts.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a block diagram of a display device according to an embodiment.

Referring to FIG. 1, the display device 10 includes a signal controller 100, a scan driver 200, a data driver 300, a power supply unit 400, a compensation control signal unit 500, and a display unit 600.

The signal controller 100 receives a video signal Ims and a synchronization signal input from an external device. The input video signal ImS may include luminance information on a plurality of pixels. The luminance has a predetermined number of grays, for example, $1024=2^{10}$, $256=2^{8}$ or $64=2^{6}$. The synchronization signal may include a horizontal synchronization signal Hsync, a vertical synchronization signal Vsync, and a main clock signal MCLK.

The signal controller 100 generates first to fourth driving control signals CONT1, CONT2, CONT3, and CONT4 and an image data signal ImD according to the video signal ImS, the horizontal synchronization signal Hsync, the vertical synchronization signal Vsync, and the main clock signal MCLK.

The signal controller 100 generates the image data signal ImD by dividing the video signal ImS into a frame unit according to the vertical synchronization signal Vsync and dividing the image data signal ImS into a scan line unit according to the horizontal synchronization signal Hsync. The signal controller 100 transmits the image data signal ImD along with the first driving control signal CONT1 to the data driver 300.

The display unit 600 is a display area including a plurality of pixels. A plurality of scan lines substantially extended in a row direction and substantially parallel with each other, a plurality of data lines and a plurality of power lines substantially extended in a column direction and substantially parallel with each other are formed in the display unit 600, and the scan lines, the data lines, and the power lines are connected to the plurality of pixels. The pixels may be arranged substantially in a matrix format.

The scan driver 200 is connected to a plurality of scan lines and generates a plurality of scan signals S[1]-S[n] according to the second driving control signal CONT2. The scan driver 200 may sequentially apply the scan signals S[1]-S[n] of the gate on voltage to a plurality of scan lines.

The data driver 300 is connected to a plurality of data lines, samples and holds the image data signal ImD input according to the first driving control signal CONT1, and respectively transmits a plurality of data signals data[1]-data[m] to a plurality of data lines. The data driver 300 applies the data signal having a predetermined voltage range to a plurality of data lines by corresponding the scan signal S[1]-S[n] of a gate-on voltage.

The power supply unit 400 determines a level of the first power source voltage ELVDD and the second power source voltage ELVSS according to the third driving control signal CONT3 to supply the level to the power source line connected to a plurality of pixels. The first power source voltage ELVDD and the second power source voltage ELVSS provide the driving current of the pixel.

The compensation control signal unit 500 determines the level of the compensation control signal GC according to the fourth driving control signal CONT4 to apply it to a compensation control line connected to a plurality of pixels.

Figure 2:
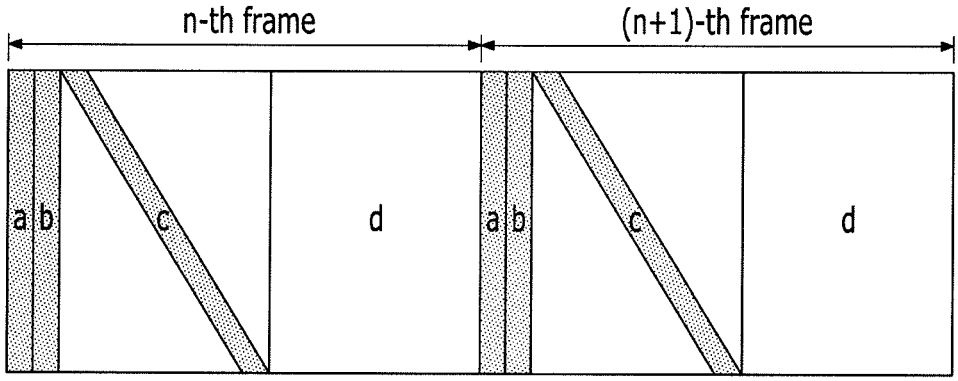
FIG. 2 is a view of a driving operation of a simultaneous light emitting method of a display device according to an embodiment.

FIG. 2 is a diagram showing a driving operation of a simultaneous light emitting method of a display device according to an embodiment.

Referring to FIG. 2, the display device 10 is described as an organic light emitting diode display using an organic light emitting diode. However, the present invention is not limited thereto, and it may be applied to various display devices.

One frame period for which one image is displayed in the display portion 600 includes (a) a reset period in which a driving voltage of the organic light emitting diode of a pixel is reset, (b) a compensation period in which a threshold voltage of the driving transistor of the pixel is compensated, (c) a scan period in which data signals are transmitted to each of a plurality of pixels, and (d) a light emitting period in which a plurality of pixels emit light to correspond to the transmitted data signals.

As illustrated in the drawings, operations for (c) the scan period are sequentially performed for each scan line, but operations for (a) the reset period, (b) the threshold voltage compensation period, and (d) the light emitting period are simultaneously performed together in the entire display portion 6.

Figure 3:
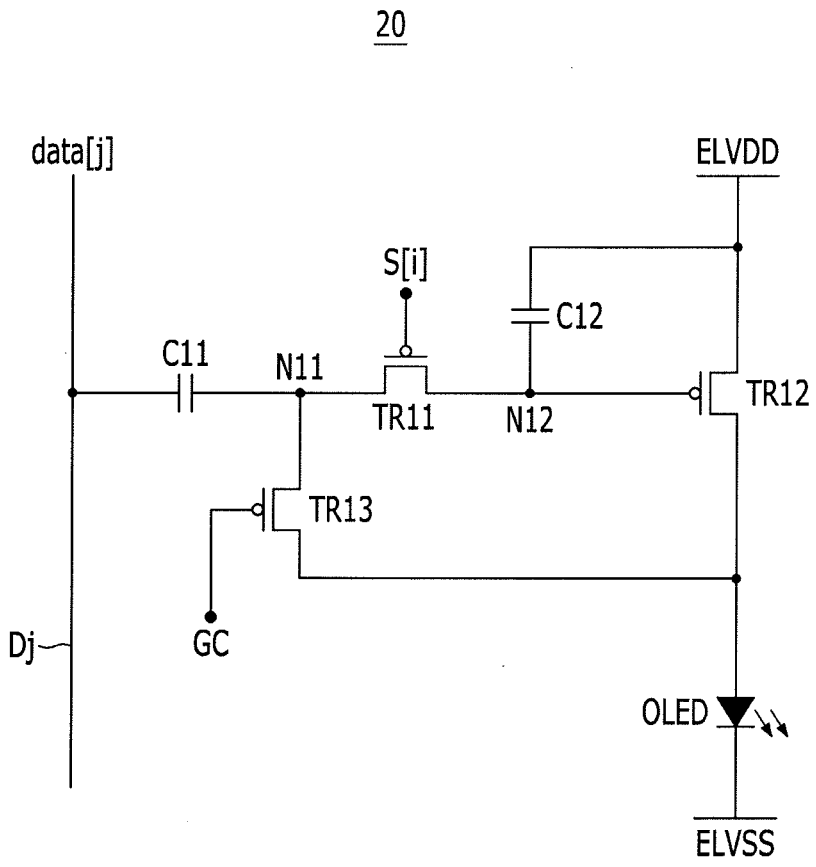
FIG. 3 is a circuit diagram of a pixel according to an embodiment.

FIG. 3 is a circuit diagram of one example of a pixel according to an exemplary embodiment of the present invention. Any one pixel of a plurality of pixels included in the display device 10 of FIG. 1 is shown.

Referring to FIG. 3, the pixel 20 includes a switching transistor TR11, a driving transistor TR12, a compensation transistor TR13, a compensation capacitor C11, a storage capacitor C12, and an organic light emitting diode (OLED).

The switching transistor TR11 includes the gate electrode connected to the scan line, one electrode connected to the first node N11, and the other electrode connected to the second node N12. The switching transistor TR11 is turned on by the scan signal S[i] of the gate on voltage Von applied to the scan line to connect the first node N11 and the second node N12.

The driving transistor TR12 includes the gate electrode connected to the second node N12, the one electrode connected to the first power source voltage ELVDD, and the other electrode connected to an anode of the organic light emitting diode (OLED). The driving transistor TR12 is turned off by the voltage of the second node N12 to control the driving current supplied to the organic light emitting diode (OLED) from the first power source voltage ELVDD.

The compensation transistor TR13 includes the gate electrode connected to the compensation control line, the one electrode connected to the first node N11, and the other electrode connected to the other electrode of the driving transistor TR12. The compensation transistor TR13 is turned on by the compensation control signal GC of the gate-on voltage to connect the first node N11 and the other electrode of the driving transistor TR12.

The compensation capacitor C11 includes one electrode connected to the data line Dj and the other electrode connected to the first node N11.

The storage capacitor C12 includes one electrode connected to the second node N12 and the other electrode connected to the first power source voltage ELVDD.

The organic light emitting diode (OLED) includes the anode connected to the other electrode of the driving transistor TR12 and the cathode connected to the second power source voltage ELVSS. The organic light emitting diode OLED may emit light of one of primary colors. The primary colors include, for example, three primary colors of red, green, and blue, and a desired color is displayed with a spatial or temporal sum of the three primary colors.

The switching transistor TR11, the driving transistor TR12, and the compensation transistor TR13 may be p-channel field effect transistors. In this case, the gate-on voltage that turns on the switching transistor TR11, the driving transistor TR12, and the compensation transistor TR13 is a logic low level voltage, and the gate-off voltage that turns off the switching transistor TR11, the driving transistor TR12, and the compensation transistor TR13 is a logic high level voltage.

Herein, the p-channel field effect transistor is illustrated, but at least one of the switching transistor TR11, the driving transistor TR12, and the compensation transistor TR13 may be an n-channel field effect transistor. In this case, the gate-on voltage turning on the n-channel field effect transistor is a logic high level voltage, and the gate-off voltage turning off the n-channel field effect transistor is a logic low level voltage.

The first power source voltage ELVDD and the second power source voltage ELVSS supply the driving voltage for the operation of the pixel.

Figure 4:
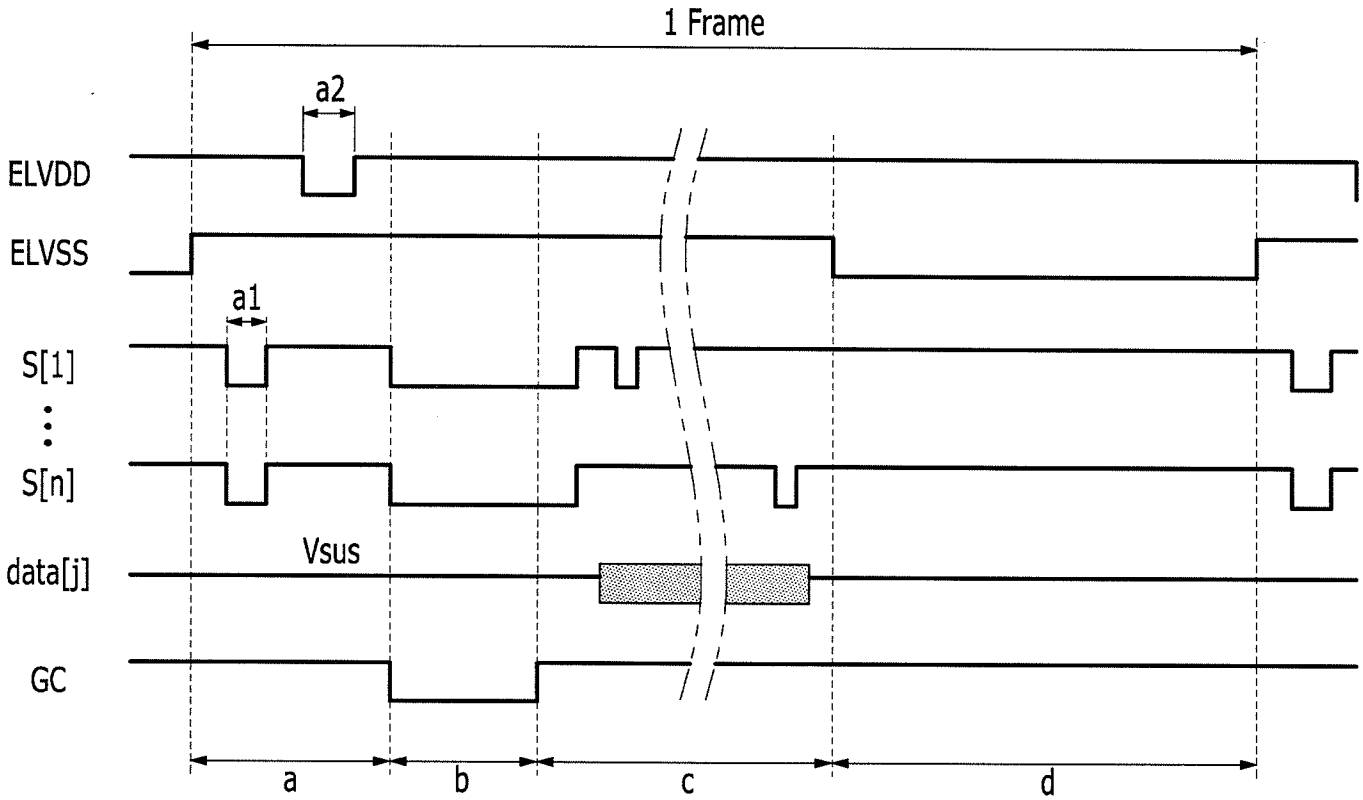
FIG. 4 is a timing diagram of a driving method of a display device according to an embodiment.

FIG. 4 is a timing diagram of a driving method of a display device according to an embodiment.

Referring to FIGS. 3 and 4, a plurality of scan signals S[1]-S[n] are applied as the logic low level voltage during the first period a1 included in the reset period (a). At this time, the first power source voltage ELVDD, the second power source voltage ELVSS, and the compensation control signal GC are applied as the logic high level voltage, and the data signal data[j] is applied as the sustain voltage Vsus. The sustain voltage Vsus is a voltage of a sufficiently low level to turning on the driving transistor TR12. The sustain voltage Vsus may be the logic low level voltage. If the data signal data[j] is applied as the sustain voltage Vsus, the voltage of e first node N11 is changed into the voltage of the low level by the coupling according to the compensation capacitor C11. At this time, the switching transistor TR11 is turned on as a plurality of scan signals S[1]-S[n] are applied as the logic low level voltage, the first node N11 and the second node N12 are connected, and the voltage of the second node N12 is changed into the voltage of the low level. That is, the voltage of the second node N12 is changed into the gate-on voltage of the driving transistor TR12.

The second power source voltage ELVSS maintains the logic high level voltage, and the first power source voltage ELVDD is converted into the logic low level voltage during the second period a2 included in the reset period (a). At this time, the scan signals S[1]-S[n]) and the compensation control signal GC are applied as the logic high level voltage, and the data signal data[j] is maintained as the sustain voltage Vsus. A voltage difference between the first power source voltage ELVDD and the second power source voltage ELVSS is reversed during the second period a2. Accordingly, an anode voltage of the organic light emitting diode (OLED) is higher than the first power source voltage ELVDD and the anode of the organic light emitting diode (OLED) becomes the source in a point of the driving transistor TR12. The gate voltage of the driving transistor TR12 is the low voltage, and the anode voltage of the organic light emitting diode (OLED) is the sum of the voltages stored to the second power source voltage ELVSS and the organic light emitting diode (OLED). The driving transistor TR12 is turned on according to a voltage difference between the gate—the source, and a current flows to the first power source voltage ELVDD from the anode of the organic light emitting diode (OLED) through the driving transistor TR12. At this time, the current flowing through the driving transistor TR12 flows until the anode voltage of the organic light emitting diode (OLED) becomes the same as the first power source voltage ELVDD.

As described above, the anode voltage of the organic light emitting diode (OLED) is reset as the logic low level voltage during the reset period (a). If the reset operation among the reset period (a) is completed, the first power source voltage ELVDD is converted into the logic high level voltage.

The scan signal S[1]-S[n] and the compensation control signal GC are applied as the logic low level voltage during the compensation period (b). At this time, the first power source voltage ELVDD and the second power source voltage ELVSS are applied as the logic high level voltage and the data signal data[j] is maintained as the sustain voltage Vsus. As the scan signals S[1]-S[n] and the compensation control signal GC are applied as the logic low level voltage, the switching transistor TR11 and the compensation transistor TR13 are turned on. As the switching transistor TR11 and the compensation transistor TR13 are turned on, the driving transistor TR12 is diode-connected, and the gate voltage (the voltage of the first node N11 and the second node N12) of the driving transistor TR12 becomes ELVDD+Vth. Also, the voltage ELVDD+Vth−Vsus is stored to the compensation transistor C11.

As described above, the voltage ELVDD+Vth−Vsus in which the threshold voltage Vth of the driving transistor TR12 is reflected is stored to the compensation capacitor C11 during the compensation period (b). The compensation control signal GC and a plurality of scan signals S[1]-S[n] are converted into the logic high level voltage after the compensation period (b). Although the compensation transistor TR13 is turned off and the switching transistor TR11 is turned-off, the voltage ELVDD+Vth−Vsus stored to the compensation capacitor C11 is maintained.

A plurality of scan signals S[1]-S[n]) are sequentially applied as the logic low level voltage during the scan period (c) to turn on the switching transistor TR11. At this time, the first power source voltage ELVDD and the second power source voltage ELVSS are the logic high level voltage. The data line Dj is applied with the data signal data[j] when the switching transistor TR11 is turned on. As the switching transistor TR11 is turned on, the first node N11 and the second node N12 are connected. Accordingly, the gate voltage Vg of the driving transistor TR12 is Vg=ELVDD+Vth+{Cth/(Cth+Cst)}(data−Vsus) and is stored to the storage capacitor C12. Here, Cth is a capacitance of the compensation capacitor C11, Cst is capacitance of the storage capacitor C12, and data is the data voltage of the data signal data[j].

As described above, the gate voltage of the driving transistor TR12 reflected with the data voltage data during the scan period (c) is stored to the storage capacitor C12.

If the light emitting period (d) is started, the first power source voltage ELVDD is maintained as the logic high level voltage and the second power source voltage ELVSS is converted into the logic low level voltage. At this time, a plurality of scan signals S[1]-S[n]) and the compensation control signal GC are applied as the logic high level voltage, and the data signal data[j] is maintained as the sustain voltage Vsus. As the second power source voltage ELVSS is converted in the logic low level voltage, the current flows to the organic light emitting diode (OLED) through the driving transistor TR12. The current I_OLED flowing to the organic light emitting diode (OLED) is $I_OLED=k(Vgs-Vth)^2=k[ELVDD+Vth+\{Cth/(Cth+Cst)\}(data-Vsus)-ELVDD-Vth]^2=k[\{Cth/(Cth+Cst)\}(data-Vsus)]^2$. The organic light emitting diode (OLED) emits light with a brightness corresponding to the current I_OLED.

That is, the organic light emitting diode (OLED) emits light with the brightness corresponding to the data voltage (data) without a deviation of the threshold voltage Vth of the driving transistor TR12 and a voltage drop of the first power source voltage ELVDD. Particularly, the capacitance Cth of the compensation capacitor C11 is larger than the capacitance Cst of the storage capacitor C12, so more current may flow to the organic light emitting diode (OLED) within a same range as an IC output of the data driver 300.

Also, the switching transistor TR11 is in the turned-off state during the light emitting period (d), and one end of the compensation transistor TR13 is connected to the first node N11 such that the gate voltage of the driving transistor TR12 is not influenced by a leakage current caused by the compensation transistor TR13 or the coupling by the voltage of other wires.

Furthermore, in the proposed pixel 20, the capacitance of the storage capacitor C12 is used as it is as a sustainment of the gate voltage of the driving transistor TR12. That is, the gate voltage Vg of the driving transistor TR12 is stored to the storage capacitor C12 and is maintained. This is to compensate a decrease of the capacitance compared with an actual area of the capacitor when the gate voltage of the driving transistor is maintained by two capacitors coupled in series in a general pixel.

Figure 5:
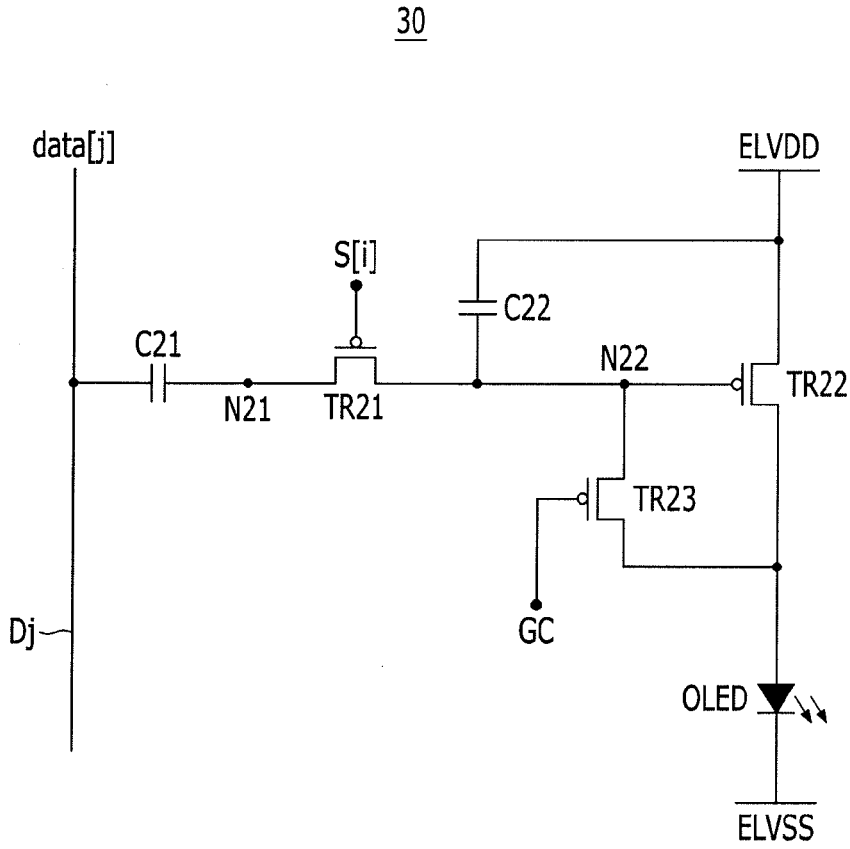
FIG. 5 is a circuit diagram of a pixel according to another embodiment.

FIG. 5 is a circuit diagram of a pixel according to another embodiment.

Referring to FIG. 5, the pixel 30 includes a switching transistor TR21, a driving transistor TR22, a compensation transistor TR23, a compensation capacitor C21, a storage capacitor C22, and an organic light emitting diode (OLED).

The switching transistor TR21 includes the gate electrode connected to the scan line, one electrode connected to the first node N21, and the other electrode connected to the second node N22.

The driving transistor TR22 includes the gate electrode connected to the second node N22, one electrode connected to the first power source voltage ELVDD, and the other electrode connected to the anode of the organic light emitting diode (OLED).

The compensation transistor TR23 includes the gate electrode connected to the compensation control line, one electrode connected to the second node N22, and the other electrode connected to the other electrode of the driving transistor TR22.

The compensation capacitor C21 includes one electrode connected to the data line Dj and the other electrode connected to the first node N21.

The storage capacitor C22 includes one electrode connected to the second node N22 and the other electrode connected to the first power source voltage ELVDD.

The organic light emitting diode (OLED) includes the anode connected to the other electrode of the driving transistor TR22 and the cathode connected to the second power source voltage ELVSS.

Compared with the pixel 20 of FIG. 3, in the pixel 30 of FIG. 5, one electrode of the compensation transistor TR23 is connected to the second node N22, as a difference. The display device including the pixel 30 of FIG. 5 is driven like the driving method described in FIG. 4.

That is, although one electrode of the compensation transistor TR23 is connected to the second node N22, the switching transistor TR21 and the compensation transistor TR23 are turned on in the threshold voltage compensation period (b) such that the driving transistor TR22 is diode-connected. Accordingly, the gate voltage of the driving transistor TR22 becomes ELVDD+Vth, and the voltage ELVDD+Vth−Vsus is stored to the compensation transistor C21.

Also, the driving method of the display device including the pixel 30 is the same as the driving method described in FIG. 4 such that it is not described in further detail.

In the pixel 30 of FIG. 5, the capacitance of the storage capacitor C22 is used as it is to maintain the gate voltage of the driving transistor TR22. Accordingly, the pixel 30 of the FIG. 5 may compensate the decrease of the capacitance compared with the actual area of the capacitor when the gate voltage of the driving transistor is maintained by two capacitors coupled in series in the conventional pixel.

According to at least one of the disclosed embodiments, coupling influence or a leakage current due to the external voltage can be minimized to each pixel such that the overall display quality of the display device is improved.

The above embodiments are presented for illustrative purposes only, and are not intended to define meanings or limit the scope of the present invention as set forth in the following claims. Those skilled in the art will understand that various modifications and equivalent embodiments of the present invention are possible without departing from the spirit and scope of the present invention defined by the appended claims.

What is claimed is:

1. An organic light emitting diode (OLED) display device comprising:

a plurality of pixels, wherein each pixel comprises:

a first capacitor including a first electrode operatively connected to a data line and a second electrode operatively connected to a first node;

a switching transistor including a gate electrode operatively connected to a scan line, a first electrode operatively connected to the first node, and a second electrode operatively connected to a second node;

a driving transistor including a gate electrode operatively connected to the second node, a first electrode operatively connected to a first power source voltage, and a second electrode operatively connected to an anode of an OLED;

a compensation transistor including a gate electrode operatively connected to a compensation control line, a first electrode operatively connected to the first node, and a second electrode operatively connected to the second electrode of the driving transistor;

a second capacitor including a first electrode operatively connected to the second node and a second electrode operatively connected to the first power source voltage;

a scan driver configured to apply a scan signal of a gate-on voltage to a plurality of scan lines operatively connected to a plurality of pixels during a first period included in a reset period for resetting a driving voltage of the OLED; and a power supply unit configured to apply a first power source voltage as a logic low level voltage during a second period included in the reset period and apply the second power source voltage applied to the cathode of the OLED as a logic high level voltage.

2. The display device of claim 1, further comprising:

a compensation control signal unit configured to apply a compensation control signal of the gate-on voltage to a plurality of compensation control lines operatively connected to a plurality of pixels during a threshold voltage compensation period for compensating a threshold voltage of the driving transistor after the reset period.

3. The display device of claim 2, wherein the scan driver is configured to apply the scan signal of the gate-on voltage during the threshold voltage compensation period to a plurality of scan lines operatively connected to a plurality of pixels to connect the first and second nodes.

4. The display device of claim 2, further comprising:

a data driver configured to apply a sustain voltage to a plurality of data lines operatively connected to a plurality of pixels during the reset period and the threshold voltage compensation period and apply a data voltage to a plurality of data line during a scan period in which a plurality of scan signals are sequentially applied after the threshold voltage compensation period.

5. An organic light emitting diode (OLED) display device comprising:

a plurality of pixels, wherein each pixel comprises:

a first capacitor including a first electrode operatively connected to a data line and a second electrode operatively connected to a first node;

a switching transistor including a gate electrode operatively connected to a scan line, a first electrode operatively connected to the first node, and a second electrode operatively connected to a second node;

a driving transistor including a gate electrode operatively connected to the second node, a first electrode operatively connected to a first power source voltage, and a second electrode operatively connected to an anode of an OLED;

a compensation transistor including a gate electrode operatively connected to a compensation control line, a first electrode operatively connected to the second node, and a second electrode operatively connected to the second electrode of the driving transistor;

a second capacitor including a first electrode operatively connected to the second node and a second electrode operatively connected to the first power source voltage;

a scan driver configured to apply a scan signal of a gate-on voltage to a plurality of scan lines operatively connected to a plurality of pixels during a first period included in a reset period for resetting a driving voltage of the OLED; and a power supply unit configured to apply a first power source voltage as a logic low level voltage during a second period included in the reset period and apply a second power source voltage applied to the cathode of the OLED as a logic high level voltage.

6. The display device of claim 5, further comprising:

a compensation control signal unit configured to apply a compensation control signal of the gate-on voltage to a plurality of compensation control lines operatively connected to a plurality of pixels during a threshold voltage compensation period for compensating a threshold voltage of the driving transistor after the reset period.

7. The display device of claim 6, wherein the scan driver is configured to apply the scan signal of the gate-on voltage during the threshold voltage compensation period to a plurality of scan lines operatively connected to a plurality of pixels to connect the first node and the second node.

8. The display device of claim 6, further comprising:

a data driver configured to 1) apply a sustain voltage to a plurality of data lines operatively connected to a plurality of pixels during the reset period and the threshold voltage compensation period, and 2) apply a data voltage to a plurality of data lines during a scan period in which a plurality of scan signals are sequentially applied after the threshold voltage compensation period.

9. A method of driving an organic light emitting diode (OLED) display device including a plurality of pixels including a first capacitor operatively connected between a data line and a first node, a switching transistor operatively connecting the first node and a second node according to a scan signal, and a driving transistor including a gate electrode operatively connected to the second node and controlling a driving current supplied to an OLED from a first power source voltage, the method comprising:

applying a scan signal of a gate-on voltage during a first period included in a reset period to operatively connect the first node and the second node, and applying a sustain voltage to the data line to change a voltage of the first node into a gate-on voltage by coupling due to the first capacitor; and applying the second power source voltage operatively connected to a cathode of the OLED during a second period included in the reset period as a logic high level voltage, and converting the first power source voltage into a logic low level voltage to reset the anode voltage of the OLED into the logic low level voltage.

10. The method of claim 9, further comprising:

turning on the switching transistor and a compensation transistor operatively connecting the first node and the anode of the OLED to diode-connect the driving transistor thereby compensating a threshold voltage of the driving transistor.

11. The method of claim 9, further comprising:

turning on the compensation transistor operatively connecting the second node and the anode of the OLED to diode-connect the driving transistor thereby compensating the threshold voltage of the driving transistor.

12. The method of claim 11, further comprising:

sequentially applying a scan signal of the gate-on voltage to turn on the switching transistor and applying a data voltage to the data line by corresponding the scan signal of the gate-on voltage to store the gate voltage of the driving transistor to the second capacitor operatively connected between the second node and the first power source voltage.

13. The method of claim 12, further comprising:

maintaining the first power source voltage as the logic high level and converting the second power source voltage into the logic low level for light emitting the OLED.

14. An organic light emitting diode (OLED) pixel comprising:

a first capacitor including a first electrode operatively connected to a data line and a second electrode operatively connected to a first node;

a switching transistor including a gate electrode applied with the scan signal, a first electrode operatively connected to the first node, and a second electrode operatively connected to a second node;

a driving transistor including a gate electrode operatively connected to the second node, a first electrode operatively connected to a first power source voltage, and a second electrode operatively connected to an anode of an OLED;

a second capacitor including a first electrode operatively connected to the second node and a second electrode operatively connected to the first power source voltage;

a scan driver configured to apply a scan signal of a gate-on voltage to a plurality of scan lines operatively connected to a plurality of pixels during a first period included in a reset period for resetting a driving voltage of the OLED; and a power supply unit configured to apply a first power source voltage as a logic low level voltage during a second period included in the reset period and apply a second power source voltage applied to the cathode of the OLED as a logic high level voltage.

15. The pixel of claim 14, further comprising:

a compensation transistor including a gate electrode applied with a compensation control signal, a first electrode operatively connected to the first node, and a second electrode operatively connected to the second electrode of the driving transistor.

16. The pixel of claim 14, further comprising:

a compensation transistor including a gate electrode applied with a compensation control signal, a first electrode operatively connected to the second node, and a second electrode operatively connected to the second electrode of the driving transistor.

* * * * *